US005205509A

United States Patent [19]

Noggle

[11] Patent Number: 5,205,509

[45] Date of Patent: Apr. 27, 1993

[54] HOSE ROLLER APPARATUS

[76] Inventor: Lance S. Noggle, 112 Tyler St., Oswego, Ill. 60543

[21] Appl. No.: 770,444

[22] Filed: Oct. 3, 1991

[51] Int. Cl.[5] ..... B65H 75/00

[52] U.S. Cl. ..... 242/86; 242/86.5 R

[58] Field of Search ..... 242/86, 86.2, 86.4, 242/86.5 R, 86.52, 94, 96

[56] References Cited

U.S. PATENT DOCUMENTS

| | | | |
|---|---|---|---|
| 1,096,232 | 5/1914 | Foster | 242/86 R |
| 1,915,632 | 6/1933 | Marks | 242/86 |
| 3,330,498 | 7/1967 | Rucky | 242/86 |
| 3,946,964 | 3/1976 | Zinser | 242/86 |
| 4,288,047 | 9/1981 | Berry et al. | 242/86 |
| 4,979,693 | 12/1990 | Eberhardt et al. | 242/86 |
| 5,033,690 | 7/1991 | McIver | 242/86 |

FOREIGN PATENT DOCUMENTS

| | | | |
|---|---|---|---|
| 13578 | 1/1990 | Japan | 242/86 |

*Primary Examiner*—Daniel P. Stodola
*Assistant Examiner*—John F. Rollins
*Attorney, Agent, or Firm*—Leon Gilden

[57] ABSTRACT

An apparatus arranged for selective securement to a receiver socket, wherein the apparatus includes a generally "S" shaped support beam mounting a crank handle at a forward end thereof to rotatably secure a fire hose thereabout. The crank handle includes an extension leg member secured to the crank handle, including an "L" shaped lock leg mounted to the extension leg to secure the hose thereto in a winding operation. The invention further includes a hose mounting bracket, wherein the extension leg is removable relative to the crank arm and securable to the mounting bracket to permit securement and storage of the hose for ease of transport thereof.

4 Claims, 5 Drawing Sheets

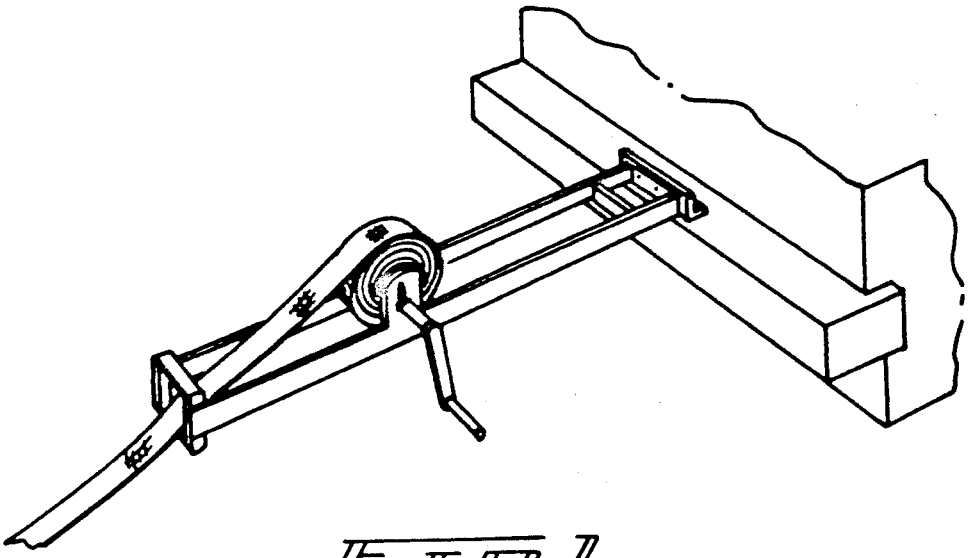
Fig 1
PRIOR ART
Fig 2
PRIOR ART
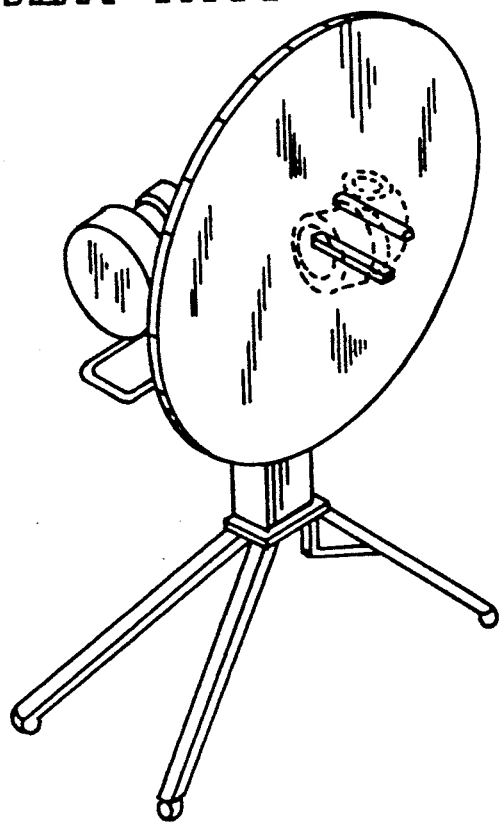

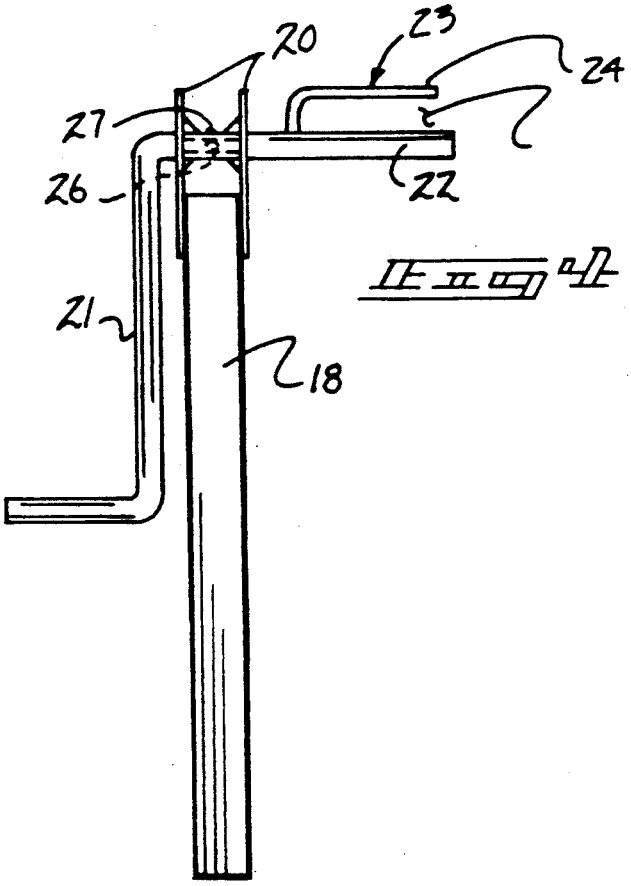
Fig 4
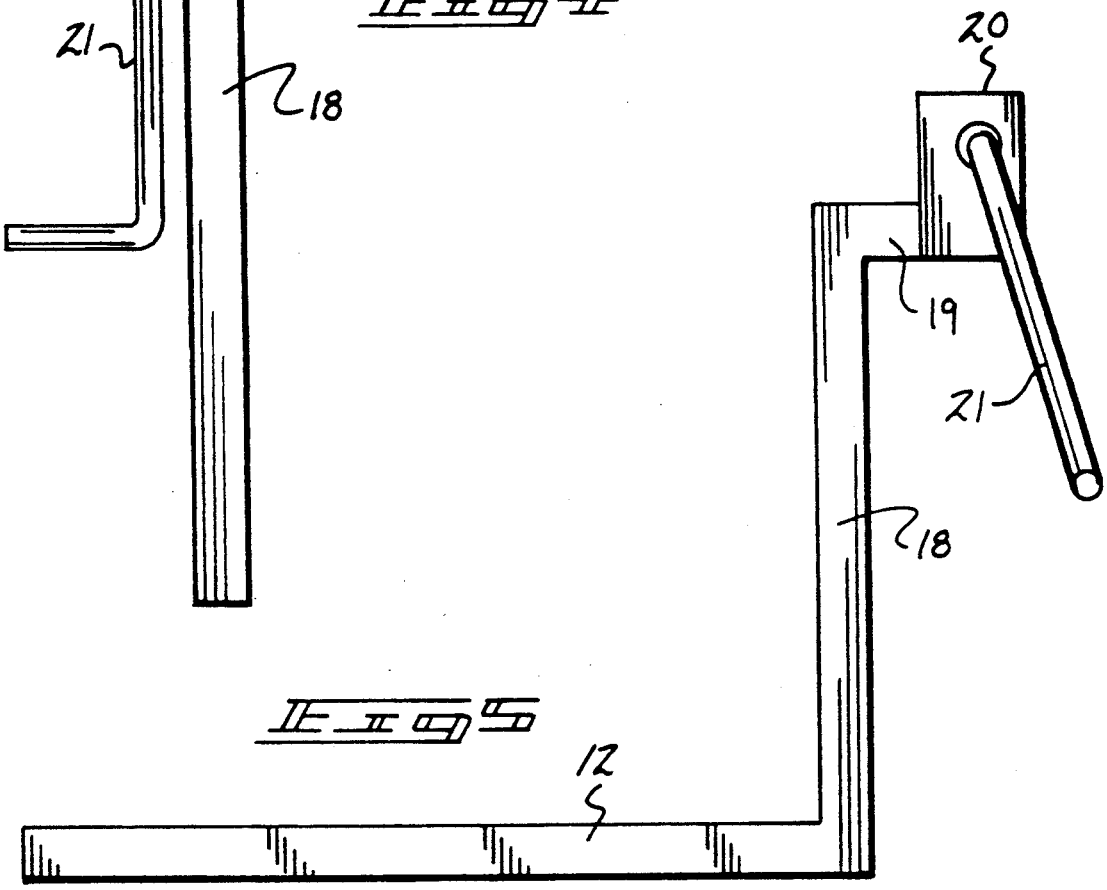
Fig 5
Fig 6
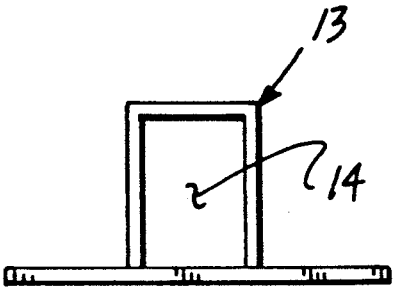
Fig 7
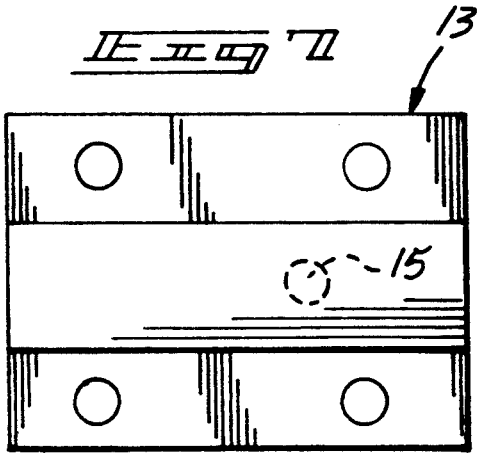

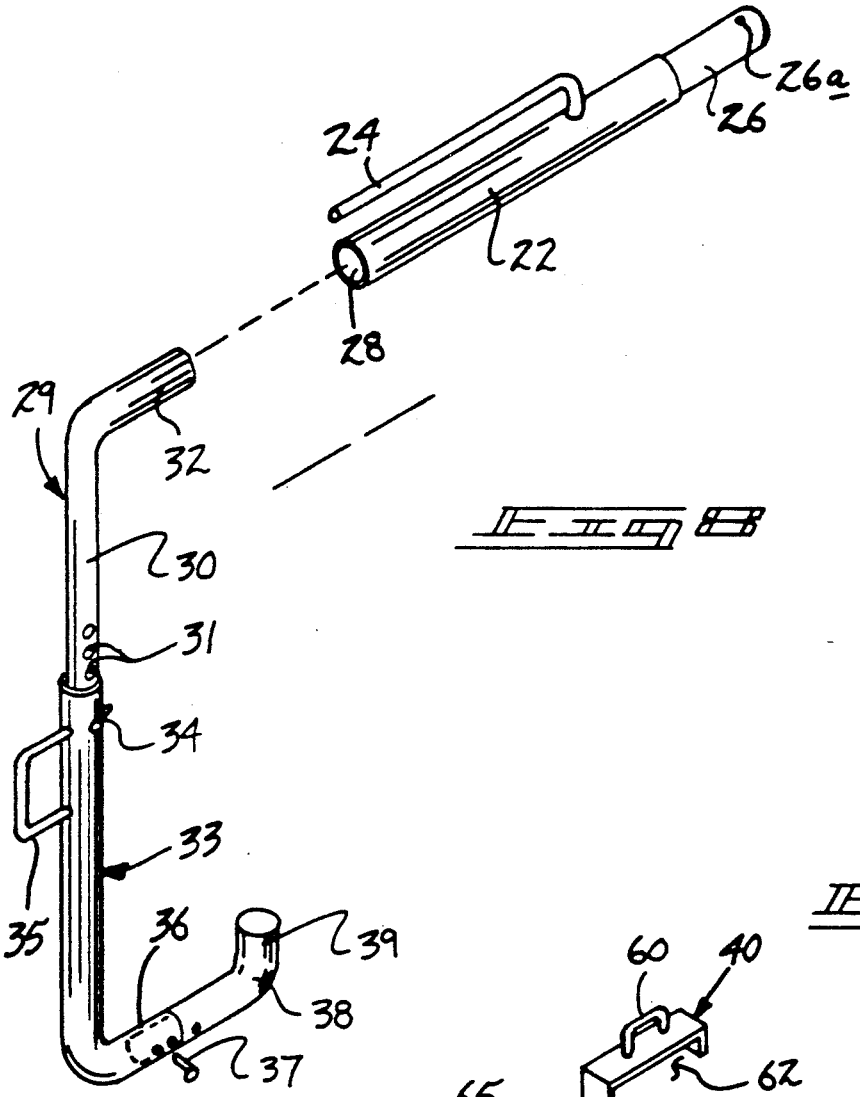
Fig 8
Fig 9
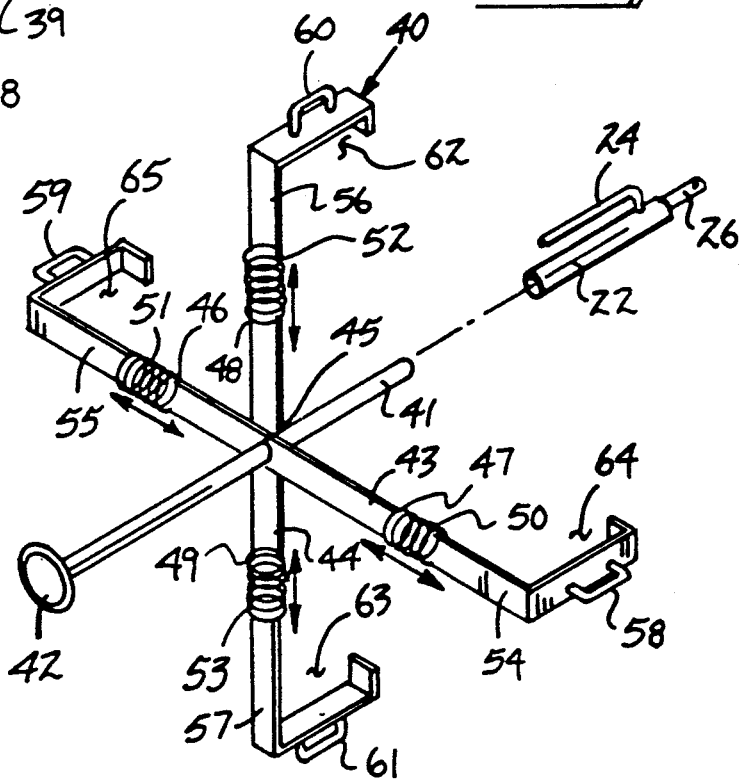

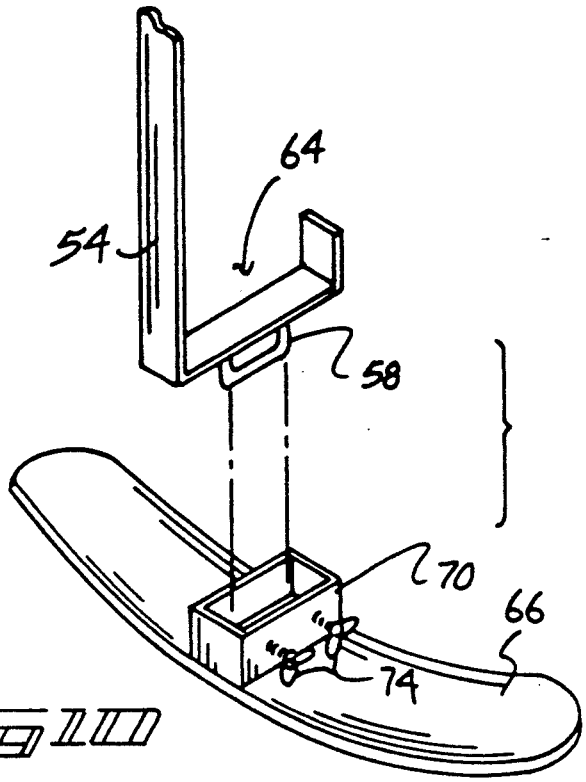
Fig 10
Fig 11
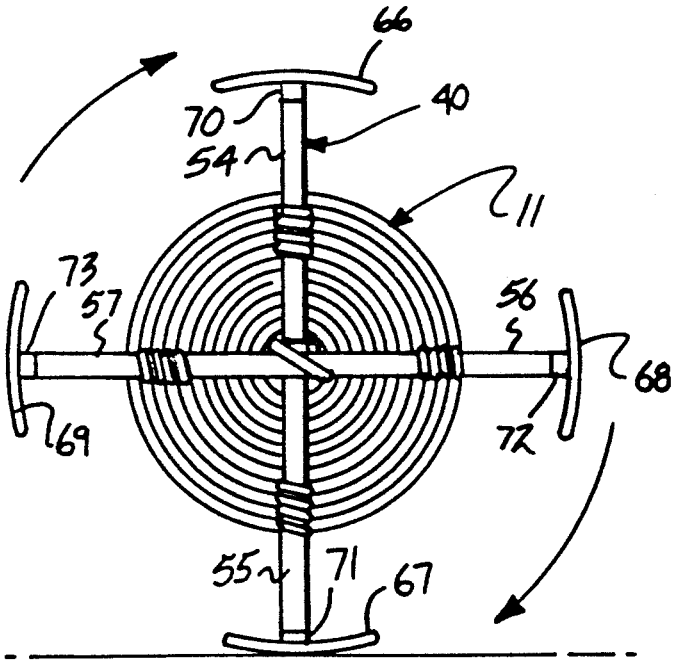

HOSE ROLLER APPARATUS

BACKGROUND OF THE INVENTION

1. Field of the Invention

The field of invention relates to hose rolling apparatus, and more particularly pertains to a new and improved hose roller apparatus wherein the same is arranged for the selective winding and reeling of a fire hose for its transport, maintenance, and storage as required.

2. Description of the Prior Art

Various hose rolling apparatus has been presented in the prior art to permit the winding and reeling of various hoses as required. Such apparatus is exemplified in U.S. Pat. No. 3,946,964 to Zinser wherein a support bracket mounts a winding structure to secure a hose thereabout.

U.S. Pat. No. 4,475,698 to Militello; U.S. Pat. No. 3,471,885 to McLoughlin, et al.; and U.S. Pat. No. 4,592,519 to Peacock are further examples of hose rolling apparatus.

As such, it may be appreciated that there continues to be a need for a new and improved hose roller apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of hose roller apparatus now present in the prior art, the present invention provides a hose roller apparatus wherein the same is arranged for the convenient winding and reeling of a hose to permit its ease of storage, transport, and maintenance in use. As such, the general purpose of the present invention, which will be described subsequently in greater detail, is to provide a new and improved hose roller apparatus which has all the advantages of the prior art hose roller apparatus and none of the disadvantages.

To attain this, the present invention provides an apparatus arranged for selective securement to a receiver socket, wherein the apparatus includes a generally "S" shaped support beam mounting a crank handle at a forward end thereof to rotatably secure a fire hose thereabout. The crank handle includes an extension leg member secured to the crank handle, including an "L" shaped lock leg mounted to the extension leg to secure the hose thereto in a winding operation. The invention further includes a hose mounting bracket, wherein the extension leg is removable relative to the crank arm and securable to the mounting bracket to permit securement and storage of the hose for ease of transport thereof.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hose roller apparatus which has all the advantages of the prior art hose roller apparatus and none of the disadvantages.

It is another object of the present invention to provide a new and improved hose roller apparatus which may be easily and efficiently manufactured and marketed.

It is a further object of the present invention to provide a new and improved hose roller apparatus which is of a durable and reliable construction.

An even further object of the present invention is to provide a new and improved hose roller apparatus which is susceptible of a low cost of manufacture with regard to both materials and labor, and which accordingly is then susceptible of low prices of sale to the consuming public, thereby making such hose roller apparatus economically available to the buying public.

Still yet another object of the present invention is to provide a new and improved hose roller apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art hose roller apparatus.

FIG. 2 is an isometric illustration of the hose roller apparatus of FIG. 1 utilizing a winding structure as depicted in U.S. Pat. No. 4,198,010.

FIG. 4 is an orthographic frontal view, taken in elevation, of the instant invention.

FIG. 5 is an orthographic side view of the invention.

FIG. 6 is an orthographic front end view of the receiving socket utilized by the invention.

FIG. 7 is an orthographic bottom view of the receiving socket, as illustrated in FIG. 6.

FIG. 8 is an isometric illustration of the invention utilizing a hose mounting bracket.

FIG. 9 is an isometric illustration of the invention in use in combination with a modified hose mounting bracket.

FIG. 10 is an isometric illustration of the mounting bracket for securement to an associated support plate.

FIG. 11 is an orthographic side view of the arcuate support plates mounted to the modified hose mounting bracket to permit ease of rolling of the organization in use.

DESCRIPTION OF THE PREFERRED EMBODIMENT

Figure 3:
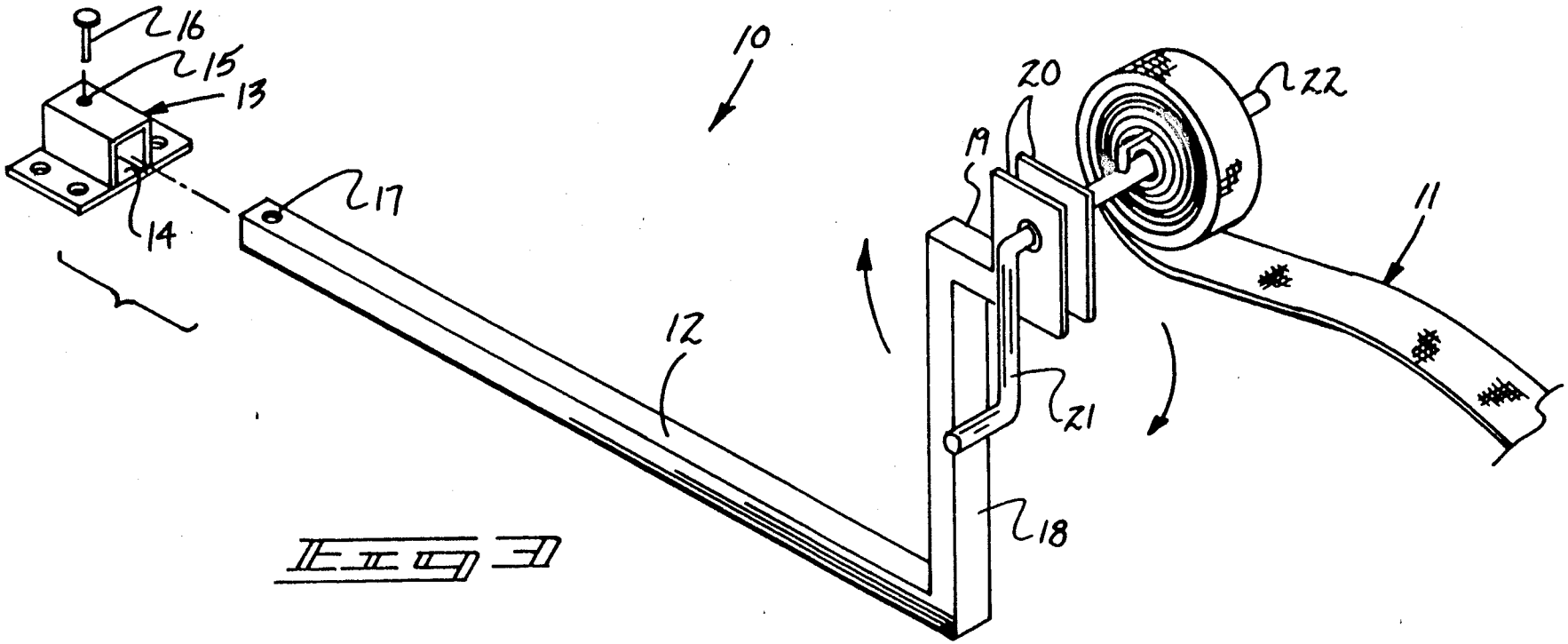
FIG. 3 is an isometric illustration of the instant invention.

With reference now to the drawings, and in particular to FIGS. 1 to 11 thereof, a new and improved hose roller apparatus embodying the principles and concepts of the present invention and generally designated by the reference numeral 10 will be described.

FIG. 1 illustrates a prior art hose roller apparatus, as set forth in U.S. Pat. No. 3,946,964, wherein the hose is rolled about a crank arm, the crank arm including an "L" shaped support leg positioned thereabove. The FIG. 2 illustrates a further prior art motorized hose roller apparatus as set forth in U.S. Pat. No. 4,198,010 to roll an associated hose about the forward plate member, as illustrated.

More specifically, the hose roller apparatus 10 of the instant invention essentially comprises a fire hose 11 to be rolled about an associated extension leg 22 as illustrated. The apparatus includes a first support beam 12 received within a receiver socket 13. The receiver socket 13 includes a socket cavity 14 to receive the rear distal end of the first support beam 12 therewithin. A first support beam bore 17 directed through the support beam is aligned with a receiver socket bore 15, with a pin 16 directed through the bores 15 and 17 to latch the support beam 12 within the socket 13. A second support beam 18 is fixedly mounted to a forward distal end of the first support beam 12 extending upwardly thereof, with a third support beam 19 orthogonally oriented relative to the second support beam extending forwardly thereof to define a generally "S" shaped support beam construction. Spaced parallel support flanges 20 are mounted to rotatably secure a crank arm 21 oriented orthogonally relative to the support flanges 20. The crank arm 21 extends through the support flanges 20 and mounts an extension leg 22 therewithin. The extension leg 22 is defined by a first diameter received within the crank arm 21, as illustrated in the FIG. 4 for example. The extension leg includes an extension leg projection cylinder 26, with a projection cylinder bore 26*a* aligned with a like bore in the crank arm 21 to utilize a projection cylinder lock pin 27 to secure the extension leg relative to the crank arm 21. An "L" shaped extension leg lock leg 23 is fixedly mounted to the extension leg to include a lock leg spaced arm 24 spaced above and parallel to define a hose coupling receiving gap 25 therebetween to secure a rear distal end of a hose 11 to be wound about the extension leg 22.

In this manner, the hose 11 is wound about the extension leg 22, in a manner as illustrated in FIG. 3.

FIG. 8 illustrates the use of a hose mounting bracket 29 for mounting and transport of a wound hose member 11. The mounting bracket 29 includes a bracket first "L" shaped leg 30 to include a lower first leg plurality of apertures 31 to be received within an upper distal end of a bracket second leg 33. A second leg first lock pin 34 telescopingly receives the first "L" shaped leg relative to the second leg 23. An upper first leg extension 32 is received within the extension leg socket 28 at a forward distal end of the extension leg 32 to mount the extension leg and a hose member 11 (not shown) wound thereabout. A second leg handle 35 mounted to the second leg permits ease of transport of the organization in an assembled configuration, wherein a bracket second leg extension 36 telescopingly receives an "L" shaped mounting leg 38, wherein the "L" shaped mounting leg 38 includes a forward end 39 orthogonally oriented relative to the second leg extension 36 to position the hose member therewithin. A second leg second lock pin 37 is utilized to latch the "L" shaped mounting leg 38 within the second leg extension 36 as illustrated a hose 11 to the extension leg 22, in manner as indicated in FIG. 3, may after removal from the windup organization as set forth in the FIGS. 3-5 be mounted to the extension leg 32 as indicated in FIG. 8, wherein the adjustable mounting leg 38 is arranged to capture the hose in adjacency to the second leg 33. The forward end 39 in cooperation with the second leg 33 and the second extension leg 36 and the mounting leg 38 provide for the confinement of the thusly wrapped hose between the forward end 39 of the "L" shaped mounting leg 38 to position the hose against the second leg 33 for ease of transport of the organization when thusly mounted.

A modified hose support bracket 40 is illustrated in the FIGS. 9-11 in use. The modified hose support bracket 40 accommodates a rolled hose 11 in a more concise clamping cooperation upon mounting the cylinder 26 onto the bracket axle 41, in a manner as indicated in FIG. 9. This bracket structure permits ease of transport of the organization, wherein the bracket 40 includes a bracket axle 41 received within the extension leg 22 through the extension leg socket 28, as illustrated in the FIG. 9. An axle handle 42 is mounted to a forward distal end of the axle 41 for ease of manual transport of the organization. A support bracket first leg 43 is orthogonally mounted to a support bracket second leg 44 at a junction 45 that medially intersects the first and second legs 43 and 44 respectively. The junction 45 is intersected by the axle 41 which is orthogonally oriented relative to the first and second legs 43 and 44. The first leg 43 includes a first leg first end 46 and a first leg second end 47. The second leg 44 includes a second leg first end and a second leg second end 48 and 49 respectively. Respective first, second, third, and fourth extension springs 50, 51, 52 and 53 are mounted to the respective ends 46, 47, 48, and 49 respectively. A "J" shaped first, second, third, and fourth bracket 54, 55, 56, and 57 respectively are respectively mounted to the respective first, second, third, and fourth extension springs, 50, 51, 52, and 53 respectively. The first and second "J" shaped brackets 54 and 55 are in a confronting relationship, as are the third and fourth "J" shaped brackets 56 and 57. In this manner, the first bracket 54 defines a first bracket cavity 62, wherein the second bracket 55 defines a second bracket cavity 63 that are in confronting relationship. The third bracket 56 is defined by a third cavity 64 that is in confronting relationship relative to a fourth cavity 65 of the respective third and fourth "J" shaped brackets 56 and 57. A first handle pair is defined by a respective first and second bracket handle 58 and 59 of the respective first and second "J" shaped brackets 54 and 55. Respective third and fourth bracket handles 60 and 61 define a second handle pair of the respective third and fourth "J" shaped brackets 56 and 57. The first and second handle pairs are used sequentially and biased apart to receive a wound coil of hose within the cavities 62–65. In this manner, the cavities 62–65 are arranged for biased communication and receiving the hose 11, in a manner as indicated in FIG. 3, within the cavities and positioned within the cavities by the configuration, as indicated in FIG. 9, within the cavities of the "J" shaped brackets 54, 55, 56, and 57.

To permit rolling of the organization of the modified hose support bracket 40, a respective first, second, third, and fourth arcuate support plate 66, 67, 68, and 69 are mounted to the respective first, second, third, and fourth respective bracket handles 58–61 in a manner as typified in the FIG. 10. Each arcuate support plate defined by the first through fourth arcuate support plates includes a respective first, second, third, and fourth respective support plate sockets 70, 71, 72, and 73 respectively to each receive a respective first through fourth handle 58–61. Socket lock fasteners 74 orthogonally oriented relative to each respective handle are received within the handle loop, as illustrated in FIG. 10, to lock the handle and associated "J" shaped bracket relative to each respective end of the first and second legs 43 and 44. In this manner, the sockets are mounted within the concave portion of each arcuate support plate, wherein the convex portion of each arcuate support plate extends outwardly of each respective first and second leg to provide a rolling surface permitting rolling of the organization for ease of transport thereof.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A winding and reeling apparatus, comprising, a support member, the support member including a first support beam, the first support beam including a rear distal end, and the first support beam including a forward distal end, the forward distal end including a second support beam fixedly mounted to the first support beam extending upwardly thereof, and the second support beam including a third support beam mounted to the second support beam, and a receiver socket, the receiver socket including a receiver socket cavity, the receiver socket cavity arranged for reception of the rear distal end of the first support beam therewithin, and the third support beam including a plurality of support flanges fixedly mounted to the third support beam extending upwardly thereof, wherein a crank arm is rotatably mounted through the support flanges, and an extension leg for receiving a hose to be wound thereon, the extension leg including an extension leg projection cylinder received within the crank arm for mounting to the crank arm, and the extension leg including an "L" shaped extension leg lock leg fixedly mounted to the extension leg, wherein the lock leg includes a spaced arm spaced above and parallel the extension leg defining a hose coupling receiving gap for receiving a hose coupling therewithin, and the extension leg projection cylinder removably mounted relative to the crank arm, and the extension leg including an extension leg forward distal end defining an extension leg socket therewithin, and a hose support bracket, the hose support bracket including a support bracket axle, the axle including an axle first end, the axle first end including a handle fixedly mounted thereto, and the axle including an axle second end, the axle second end complementarily receivable within the extension leg socket for mounting the extension leg on the axle, and a support bracket first leg fixedly and orthogonally mounted to a support bracket second leg, the first leg and the second leg orthogonally and integrally mounted to one another bisecting one another at a junction, and the axle orthogonally directed through the first leg and the second leg at the junction extending through the junction, and the first leg includes a first leg first end and first leg second end, the second leg includes a second leg first end and a second leg second end, the first leg first end includes a first extension spring, the first leg second end includes a second extension spring, the second leg first end including a third extension spring, and the second leg second end including a second extension spring, and the first extension spring and the second extension spring coaxially aligned relative to one another and longitudinally aligned with the first leg, and the third extension spring and the fourth extension spring coaxially aligned relative to one another and longitudinally aligned with the second leg, and the first extension spring including a "J" shaped first bracket fixedly mounted thereto spaced from the first leg first end, and the second extension spring including a "J" shaped second bracket fixedly mounted to the second extension spring spaced from the first leg second end, and the third extension spring including a "J" shaped third bracket, fixedly mounted thereto spaced from the second leg first end, and a "J" shaped fourth bracket fixedly mounted to the fourth extension spring spaced from the second leg second end, wherein the first bracket and the second bracket each include a respective first bracket cavity and second bracket cavity, wherein the first bracket cavity and the second bracket cavity are in confronting relationship relative to one another, and the third bracket and the fourth bracket include a third cavity and fourth cavity, wherein a third cavity and a fourth cavity are in confronting relationship relative to one another, wherein the first cavity, second cavity, third cavity, and the fourth cavity are arranged for reception of a coiled hose therewithin.

2. An apparatus as set forth in claim 1 wherein the first bracket includes a first bracket handle mounted thereon, the second bracket includes a second bracket handle mounted thereon, wherein the first bracket handle and the second bracket handle define a first handle pair, and the third bracket and the fourth bracket include a respective third bracket handle and fourth bracket handle mounted to the respective third bracket and fourth bracket to define a second handle pair, wherein the first handle pair and the second handle pair are adapted to be spread to receive the coiled hose within the first, second, third, and fourth bracket cavities.

3. An apparatus as set forth in claim 2 including a first arcuate support plate mounted to the first handle, a second arcuate support plate mounted to the second handle, a third support plate mounted to the third handle, and a fourth support plate mounted to the fourth handle, the first support plate includes a first support socket, the second support plate includes a second support socket, the third support plate includes a third support plate socket, and the fourth support plate includes a fourth support plate socket, wherein the first socket receives the first handle, the second socket receives the second handle, the third socket receives the third handle, and the fourth socket receives the fourth handle, wherein the first, second, third, and fourth sockets are received within the a respective concave surface of the respective first, second, third, and fourth support plates.

4. An apparatus as set forth in claim 3 wherein each socket includes at least one fastener directed into the socket to secure one of said first, second, and third handles therewithin.

* * * * *